US006277052B1

(12) United States Patent
Howard

(10) Patent No.: US 6,277,052 B1
(45) **Date of Patent: *Aug. 21, 2001**

(54) METHOD AND SYSTEM FOR PASSIVELY EXERCISING SELECTED PORTIONS OF A HUMAN BODY

(76) Inventor: Kenneth W. Howard, Rte. 1, Box 151-B, DeKalb, TX (US) 75559

( * ) Notice: Subject to any disclaimer, the term of this patent is extended or adjusted under 35 U.S.C. 154(b) by 0 days.

This patent is subject to a terminal disclaimer.

(21) Appl. No.: 09/490,333

(22) Filed: Jan. 24, 2000

Related U.S. Application Data

(63) Continuation-in-part of application No. 09/086,549, filed on May 28, 1998, now Pat. No. 6,030,318.

(51) Int. Cl.[7] ..... A61H 9/00
(52) U.S. Cl. ..... 482/4; 601/6
(58) Field of Search ..... 482/4; 601/1, 6, 601/7–11, 76, 84, 148, 151; 604/74

(56) References Cited

U.S. PATENT DOCUMENTS

| | | | |
|---|---|---|---|
| 4,754,748 | 7/1988 | Antowski . | |
| 4,836,192 | 6/1989 | Abbate . | |
| 5,514,079 | 5/1996 | Dillon . | |
| 5,520,613 * | 5/1996 | Copelan | 601/14 |
| 5,562,604 | 10/1996 | Yablon et al. . | |
| 5,571,084 | 11/1996 | Palmer . | |
| 5,674,262 | 10/1997 | Tumey . | |

* cited by examiner

*Primary Examiner*—Glenn E. Richmon
(74) *Attorney, Agent, or Firm*—Carr & Storm, L.L.P.; Jack D. Stone, Jr.

(57) ABSTRACT

A method and system for passively exercising a selected portion of a human body by applying a partial vacuum pressure to the selected portion of the human body; maintaining the partial vacuum pressure applied to the selected portion of the human body for a first predetermined period of time; releasing the partial vacuum pressure so that substantially atmospheric pressure is applied to the selected portion of the human body; and maintaining the substantially atmospheric pressure applied to the selected portion of the human body for a second predetermined period of time.

30 Claims, 5 Drawing Sheets

METHOD AND SYSTEM FOR PASSIVELY EXERCISING SELECTED PORTIONS OF A HUMAN BODY

CROSS-REFERENCE TO RELATED APPLICATION

This application is a continuation-in-part of U.S. Pat. No. formerly co-pending patent application Ser. No. 09/086,549, to Kenneth W. Howard, entitled "METHOD AND SYSTEM FOR PASSIVELY EXERCISING SELECTED PORTIONS OF A HUMAN BODY", filed May 28, 1998, and issued Feb. 29, 2000.

FIELD OF THE INVENTION

The invention relates generally to a method and system for passively exercising a selected portion of a human body and, more particularly, to such a method and system wherein a vacuum pressure is cyclically applied to the selected portion of the human body to stimulate circulation of blood through the selected portion.

BACKGROUND OF THE INVENTION

Many procedures and techniques are available to aid people in acquiring the physical appearance they desire and to provide people with certain therapeutic effects they need for their bodies. For example, it is often desirable to remove excess fat from a body. One way to do remove excess fat is by dieting and exercising. Diet and exercise, however, require much self-discipline and are difficult to sustain over long periods of time. Alternatively, excess fat may be removed surgically through liposuction. Liposuction, however, is very expensive and commonly leaves a person in pain and with bruises.

In another example, women often desire to enhance the size of their breasts. Typically, this is also done using surgical procedures, namely, through silicon implants. Silicon implants, however, have uncertain and potentially dangerous side effects and therefore risky. They are, furthermore, prohibitively expensive for many women.

In still further examples, medicine, surgery, chiropractic therapy, and/or massage therapy is commonly used to remedy other ailments such as sores, wrinkles, back pain, infantilism (e.g., unemerged testicles), and urological problems. Such remedies, however, are invasive, expensive, of questionable value, and/or leave scars.

Accordingly, a continuing search has been directed to the development of methods and systems which can reduce fat without diet, exercise, or surgery, which can enhance the size of breasts without silicon implants, and which can enhance or therapeutically heal other portions of a body without expensive medicine, surgery, or chiropractic or massage therapy.

SUMMARY OF THE INVENTION

According to the present invention, it has been found that fat may be removed, and that selected portions of the body may be enhanced and/or healed by applying a partial vacuum pressure to the selected portion of the human body; maintaining the partial vacuum pressure applied to the selected portion of the human body for a first predetermined period of time; releasing the partial vacuum pressure so that substantially atmospheric pressure is applied to the selected portion of the human body; and maintaining the substantially atmospheric pressure applied to the selected portion of the human body for a second predetermined period of time.

The present invention also provides for a system for passively exercising a selected portion of a human body, wherein the system is comprised of a pump configured for generating a partial vacuum pressure; a first valve connected in fluid communication with an output of the pump; a second valve in fluid communication with atmospheric pressure; a sealing device configured for providing a pressure seal over the selected portion of the human body, the sealing device being connected in fluid communication with the first valve so that when the first valve is open, fluid communication is established between the sealing device and the output of the pump, the sealing device being connected in fluid communication with the second valve so that when the second valve is open, fluid communication is established between the sealing device and atmospheric pressure; and a controller configured for controlling the opening and closing of the first valve and the second valve in response to signals received from a computer.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

Figure 1:
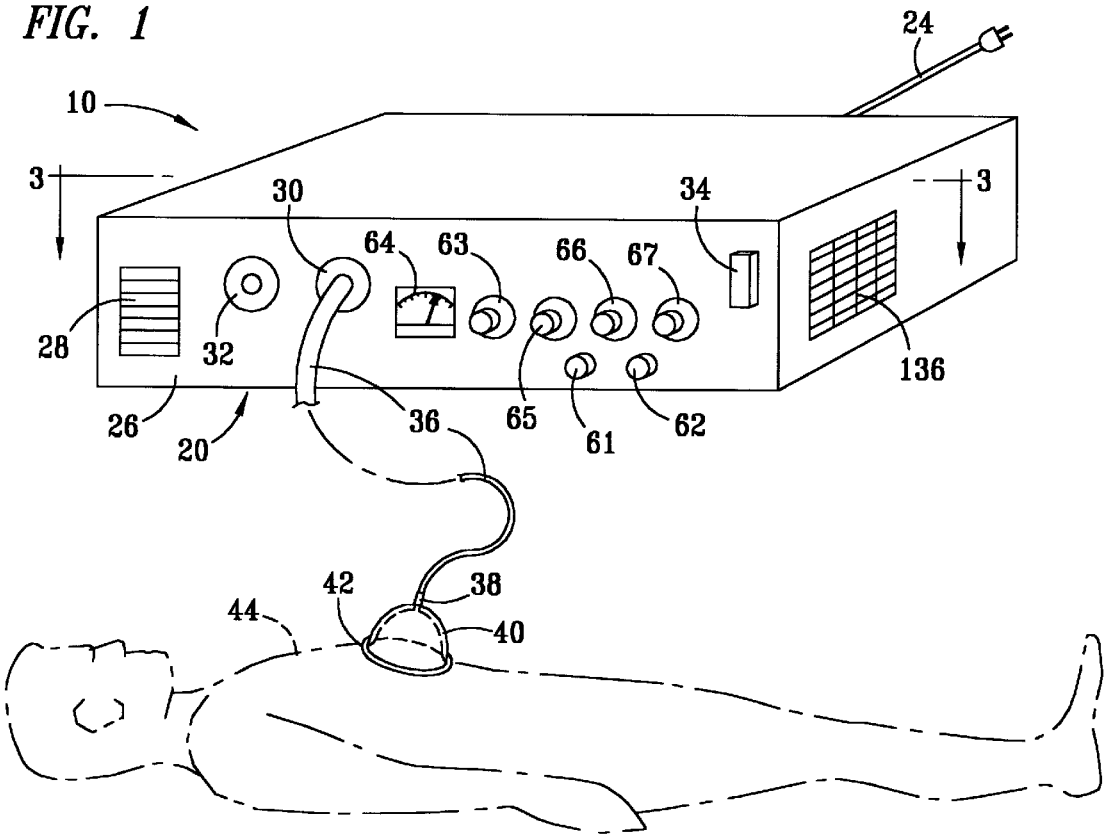
FIG. 1 is a perspective view of an embodiment of the present invention being used to passively exercise a selected portion of a human body.

In the discussion of the Figures, the same reference numerals will be used throughout to refer to the same or similar components. In the interest of conciseness, various components known to the art, such as valves, tubing, computer components, and the like necessary for the operation, control, and utilization of the present invention, have not been shown or discussed in detail.

Referring to FIG. 1 of the drawings, the reference numeral 10 generally designates a passive exercise system embodying features of the present invention. The system 10 includes a vacuum pressure generator unit 20 defining a frontal portion 26 having a vent 28 for permitting air to flow into and out of the generator unit 20, a vacuum outlet 30, a pressure inlet 32, and a power switch 34 operable for activating power to the generator unit. A pneumatic tube 36 is connected between the vacuum outlet 30 and a nipple 38 of a sealing device 40, described below, for providing fluid communication between the vacuum outlet 30 and the sealing device 40. As shown in FIG. 1, the pressure inlet 32 is configured for receiving atmospheric air. As described below with respect to an alternate embodiment depicted in FIG. 6, a tube may be attached to the pressure inlet 32 to permit the inlet 32 to receive alternate gaseous fluids such as oxygen. The generator unit 20 also includes a power cord 24 for receiving operating power from a conventional power supply (not shown), such as an AC (alternating current) plug outlet.

As described in greater detail below, the frontal portion 26 of the generator unit 20 also includes start and stop buttons 61 and 62, respectively, a pressure control knob 63 for setting a maximum vacuum pressure applied through the sealing device 40, and a pressure gauge 64 for monitoring the pressure applied to the sealing device 40. The generator unit 20 also includes three timers, namely, a vacuum hold timer 65 for controlling the amount of time a vacuum is held, an atmospheric pressure hold timer 66 for controlling the amount of time that atmospheric pressure is held, and a treatment timer 67 for controlling the total amount of time of a treatment.

The sealing device 40 preferably comprises a single piece of material such as polyethylene or the like having sufficient structural integrity to withstand a partial vacuum pressure of up to 40 kilo paschals, hereinafter "kPa," wherein 1 kPa is equal to approximately 1% of atmospheric pressure at sea level on a standard day. The nipple 38 and a flange portion 42 of the sealing device 40 are preferably formed as integral portions of the single piece of material from which the sealing device 40 is comprised; the nipple and flange portion may optionally be discrete elements secured to the sealing device. The flange portion 42 is sized and configured for sealingly conforming to and engaging skin surrounding a selected portion of a human body 44, as exemplified in FIG. 1, which selected portion may be circular, oval, square, rectangular, or the like.

Figure 2A:
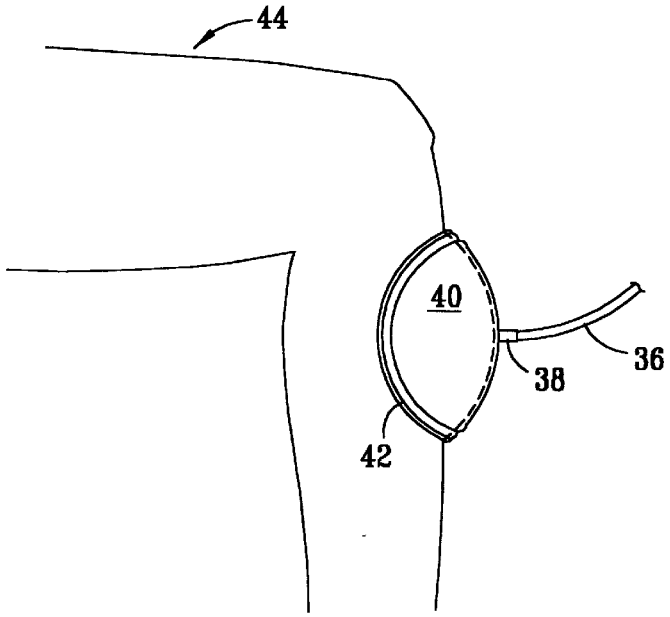
FIGS. 2A–2G show alternative embodiments of sealing devices that may be used with the system of FIG. 1.
Figure 2B:
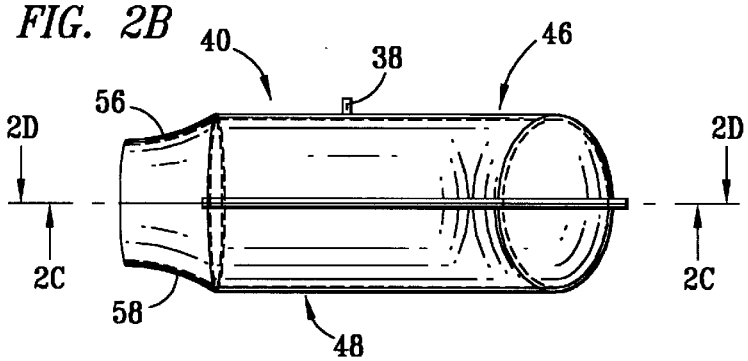
Figure 2C:
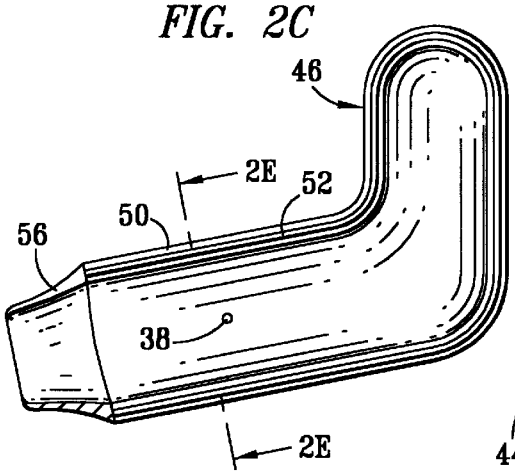
Figure 2C:
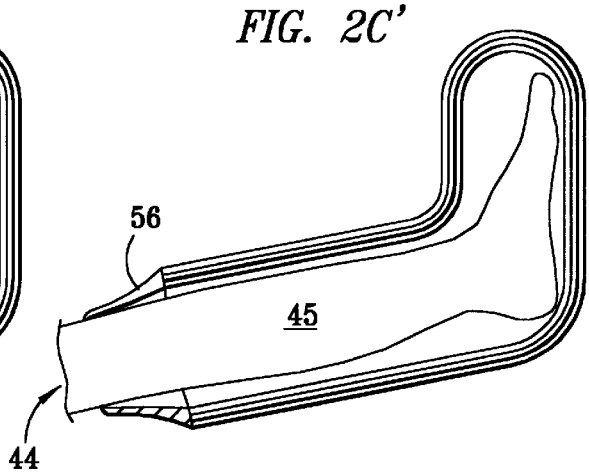
Figure 2D:
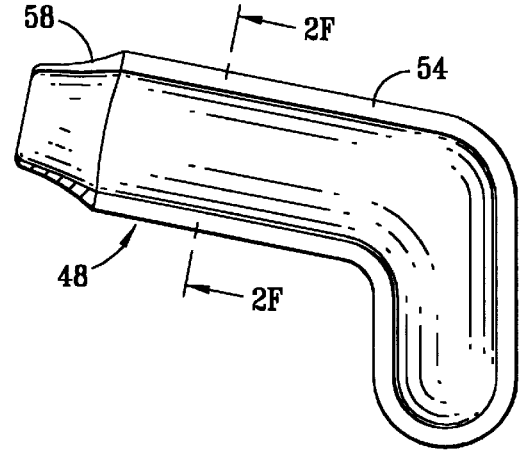
Figure 2F:
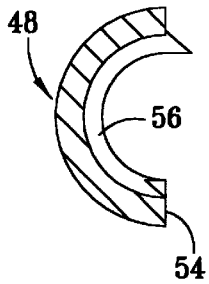
Figure 2E:
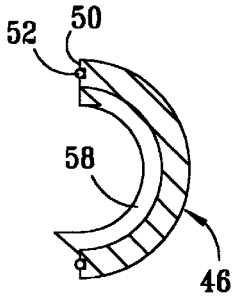
Figure 2G:
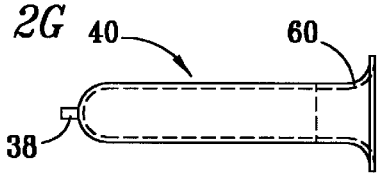

While the sealing device 40 is shown in FIG. 1 as having a generally semispherical dome shape, it may be configured in any of a number of different configurations, such as a tubular shape, a clam-shell shape, or the like. Such configurations of the flange portion 42 and of the sealing device 40 are considered to be obvious and desirable by those skilled in the art based upon a review of the present description of a preferred embodiment for providing a seal about any selected portion of a human body, such as fatty tissue, muscle tissue, a breast, a penis, a portion of a leg, a foot, a portion of an arm, a hand, a portion of a back, a healing portion of skin, a wrinkled portion of skin, or the like. For example, FIG. 2A shows a sealing device 40 configured for providing a seal to a curved skin surface such as a portion of a leg or an arm. FIG. 2B depicts a top view of an alternate embodiment of the sealing device 40 for enclosing a protruding body part such as an entire foot and lower portion of a leg, the sealing device having first and second portions 46 and 48 positioned together, which portions may be secured together as so positioned using tape (not shown). The nipple 38 is positioned on the first portion 46 for providing fluid communication between the vacuum outlet 30 and the sealing device 40. As shown in FIGS. 2C and 2E, the first portion 46 defines an edge 50 having a groove formed therein for receiving a gasket 52. As shown in FIGS. 2D and 2F, the second portion 48 defines a flat edge 54 for engaging and compressing the gasket 52 when the portions 46 and 48 are secured together as shown in FIG. 2B to thereby maintain a seal between the portions 46 and 48. As shown in FIGS. 2B–2D, pliable sealing lips 56 and 58 extend from the portions 46 and 48, respectively, and curve inwardly for providing a seal between the sealing device 40 and the user's leg. As shown more clearly in FIGS. 2E and 2F, the sealing lips 56 and 58 are configured to sealingly overlap each other. FIG. 2C' exemplifies how the sealing device 40 of FIGS. 2B–2F may be fitted for operation over a foot and lower leg portion 45 of a user. In yet another alternate embodiment of the sealing device 40, FIG. 2G depicts an elongated sealing device having a cylindrical cross-section (not shown) sized for sealing off a penis (not shown). The sealing device depicted in FIG. 2G includes a pliable base portion 60 for sealingly conforming to the base of a penis and scrotum.

Figure 3:
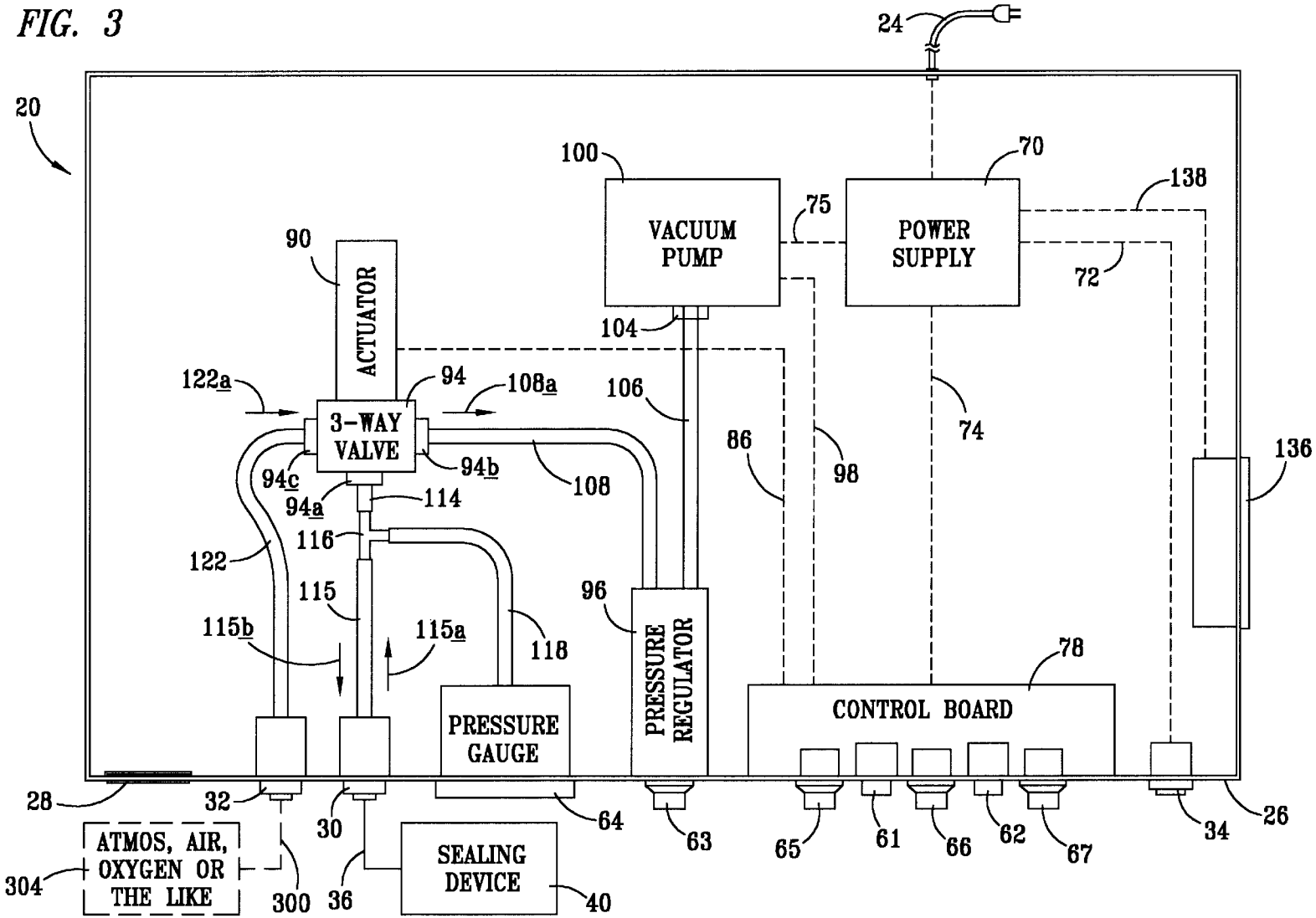
FIG. 3 is a plan view of the interior of a vacuum pressure generator unit taken along the line 3—3 of FIG. 1.

FIG. 3 shows a plan view of the interior of a preferred embodiment of the vacuum pressure generator unit 20 taken along the line 3—3 of FIG. 1. Dashed lines within the generator unit 20 represent one or more electrical lines. The power cord 24 is connected for supplying power to a power supply 70 mounted in the vacuum pressure generator unit 20, and lines 72 are connected between the power supply 70 and the power switch 34 for activating and deactivating the power supply 70. Electrical lines 74 and 75 carry electrical power to a circuit board, referred to herein as a control board, 78 and to a vacuum pump 100, respectively. While not shown, attached to the control board 78 are preferably a suitable microprocessor, memory, internal clock, and appropriate resistors, transistors, capacitors, semi-conductors, and other circuit elements arranged and interconnected for providing control logic adapted for performing functions, described in greater detail below, required for the operation of the vacuum pressure generator unit 20 in response to the setting of the start and stop buttons 61 and 62, respectively, and the timers 65, 66, and 67. Because the implementation details of the control board 78 will be apparent to a skilled artisan based upon a review of the present description of the invention, the control board 78 will not be described in further detail herein. The control board 78 is connected via a line 98 for carrying control signals to the vacuum pump 100, and is connected via a line 86 for carrying control signals to an actuator 90, which is adapted to control a three-way valve 94. The actuator 90 may be any device operable to control a three-way valve, such devices as solenoids, motors in combination with gear mechanisms, or the like, well known to those skilled in the art. The valve 94 may be any suitable three-way valve controllable by the actuator 90 for effecting fluid communication between a first port 94*a* and one of either a second port 94*b* or a third port 94*c*.

The vacuum pressure pump 100 is mounted in the vacuum pressure generator unit 20 and may be any suitable electrically-powered pump preferably having at least 0.05 horsepower and capable of pulling a partial vacuum of at least 50 kPa. Such vacuum pumps are considered to be well known to those skilled in the art and will therefore not be described in further detail. The pump 100 includes a vacuum outlet connector 104 connected in fluid communication via a tube 106 to an inlet on a vacuum control valve 96, such as a pressure regulator, controlled by the pressure control knob 63. An outlet of the vacuum control valve 96 is connected in fluid communication through a tube 108 to the second port 94*b* of the three-way valve 94. Two tubes 114 and 115, and a tee 116 serially connected between the tubes 114 and 115, are connected in fluid communication between the first port 94*a* of the three-way valve 94 and the vacuum outlet 30 extending through the frontal portion 26 of the vacuum pressure generator unit 20. The tee 116 is further connected in fluid communication through a tube 118 to the pressure gauge 64. A tube 122 is connected in fluid communication between the third port 94*c* of the three-way valve 94 and the pressure inlet 32 extending through the frontal portion 26 of the vacuum pressure generator unit 20.

The vacuum pressure generator unit 20 preferably further includes an electrically-powered fan 136 suitably positioned in an opening of the box. The fan 136 is connected via lines 138 for receiving electrical power from the power supply 70 and, upon receiving such power, for causing air to flow through the vent 28 across components in the generator unit 20, to thereby cool such components, and to then flow through the fan 136 out of the generator unit 20.

Figure 4:
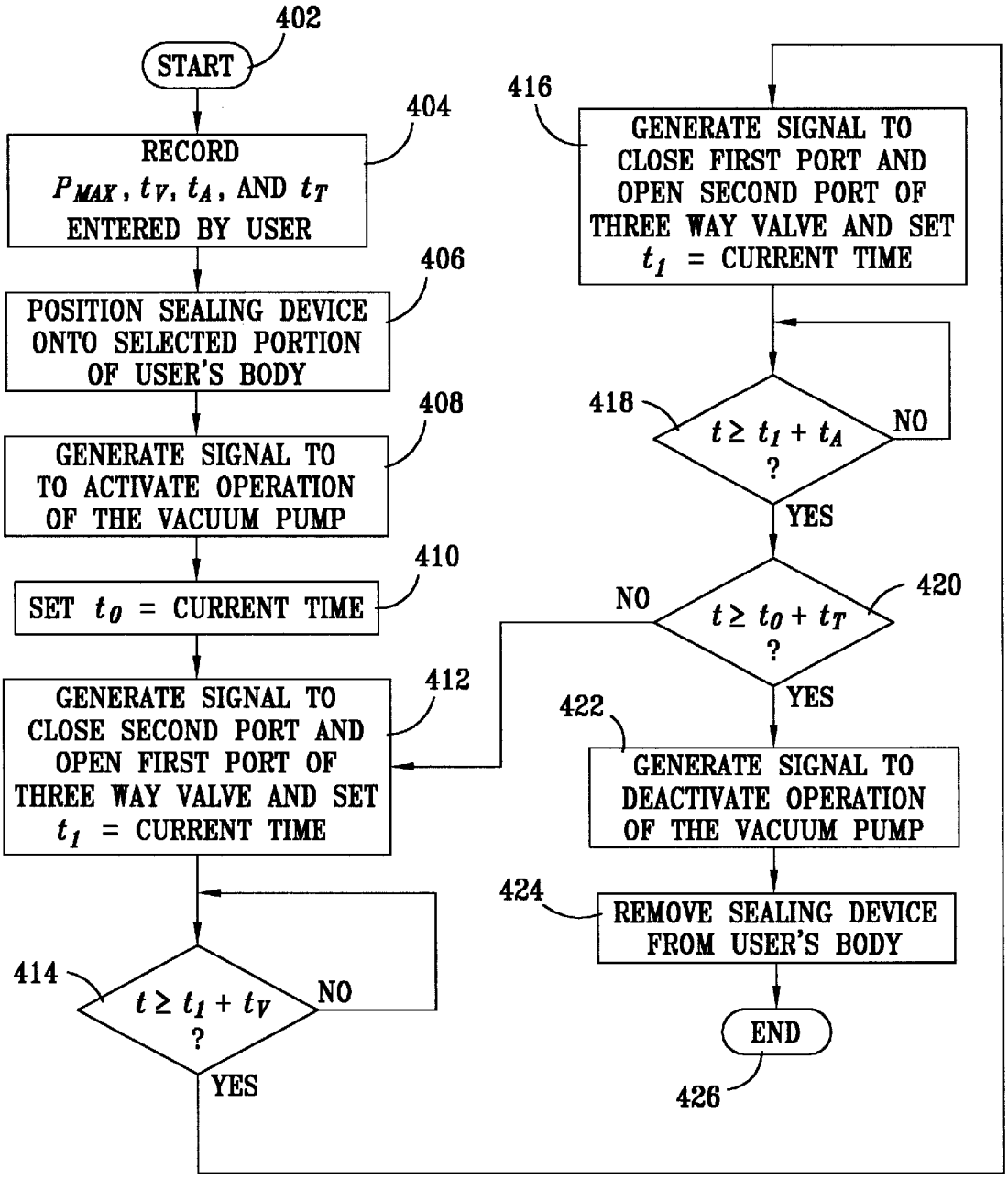
FIG. 4 is a flowchart illustrating control logic for operating the system of FIG. 1 in accordance with the present invention.

FIG. 4 is a flowchart of control logic implemented by a control program stored in the memory of the control board 78 for operating the system 10 (FIG. 1), in accordance with a preferred embodiment of the present invention, on a selected portion of a user's body, such as the body 44 exemplified in FIG. 1. In step 402, a user powers up the system 10 via the power switch 34. In step 404, the user adjusts the pressure control 63 to set a desired maximum vacuum pressure $P_{max}$ that is to be pulled by the system 10. In step 404, the user also adjusts the vacuum hold control 65 to set the amount of time $t_V$ that a vacuum should be pulled on the sealing device 40 during each cycle of operation, and adjusts the atmospheric hold control 66 to set the amount of time $t_A$ that vacuum pressure in the sealing device 40 should be released to atmospheric pressure during each cycle of operation, and adjusts the treatment time control 67 to set the total amount of time $t_T$ that the system 10 should continue to cycle the sealing device 40 through vacuum and atmospheric pressure. The values of $P_{max}$, $t_V$, $t_A$, and $t_T$ set by the user are entered into the memory of the control board 78.

The values of $P_{max}$, $t_V$, $t_A$, and $t_T$, may be set based on a number of factors, such as past treatment performed on the body of the user, the medical history of the user, the selected portion of the user's body to be treated, what is desired to be achieved by treatment, and the like. For example, it has been found that, generally, fatty tissue may be removed by setting each $t_V$ and $t_A$ in the range of from about 1 second to about 5 seconds, and typically from about 1.5 seconds to about 3 seconds, and preferably about 2 seconds. Furthermore, it has been found that, generally, the size of organs such as a breast or penis, may be enhanced by using larger values of $t_V$ and $t_A$, each generally ranging from about 2 seconds to about 12 seconds, and typically from about 5 seconds to about 8 seconds, and preferably about 6 seconds. It has also been found that treatments are effective when administered for periods of time $t_T$ ranging from about 10 to about 60 minutes and, typically, from about 20 to about 45 minutes and, preferably, about 30 minutes. Effective vacuum pressures $P_{max}$ have been found to range from about 5 kPa of vacuum to about 40 kPa of vacuum, and typically from about 10 kPa of vacuum to about 30 kPa of vacuum, and preferably about 20 kPa of vacuum.

Upon execution of the foregoing step 404, in step 406, the sealing device 40 is positioned onto a selected portion of the user's body 44. In step 408, the start switch 61 is engaged to cause the control board 78 to generate a signal onto the line 98 to activate operation of the vacuum pump 100, and execution proceeds to step 410. In step 410, the control board 78 sets a time value to equal to the current time, in a manner well-known in the art, using a time value available from the internal clock (not shown) mounted on the control board 78.

In step 412, the control board 78 generates a signal onto the line 86 to the actuator 90 to close the third port 94*c* and open the second port 94*b* of the three-way valve 94. The action of the actuator 90 permits the vacuum pump 100 to pull a vacuum through the tube 106, the control hold pressure regulator 96, the tube 108 (the direction of air flow therethrough being indicated schematically by the arrow 108*a*), the three-way valve 94, the tube 114, the tee 116, the tube 115 (the direction of air flow therethrough being indicated schematically by the arrow 115*a*), the vacuum outlet 30, the tube 36, and the sealing device 40, until the maximum vacuum pressure $P_{max}$ in the sealing device 40 is attained, which vacuum pressure is applied to the selected portion of the user's body 44. When the maximum vacuum pressure $P_{max}$ is attained, the vacuum control pressure regulator 96 shuts off fluid communication between the vacuum pump 100 and the three-way valve 94, to thereby maintain $P_{max}$ in the sealing device 40 until the third port 94*b* is open, as discussed below with respect to step 416. The vacuum control pressure regulator 96 may optionally be configured to also re-open fluid communication between the vacuum pump 100 and the three-way valve 94 to provide for vacuum pressure to be increased to $P_{max}$ if the sealing device should fail to maintain an adequate seal and leak vacuum pressure. In step 412, the control board 78 also sets a time value $t_1$, equal to the current time (i.e., the time at which the control board 78 generates the foregoing signal to activate the actuator 90 to open the second port 94*b*), in a manner well-known in the art, using a time value available from the internal clock (not shown) mounted on the control board 78.

In step 414, the current time t is compared with the sum of $t_l$ and $t_V$. If the current time t is less than the sum of $t_1$, and $t_V$, then the step 214 is repeated, the port 94*b* is held open, and vacuum pressure is increased or maintained in the sealing device 40, depending on the pressure regulator 96, as discussed above. During the period of time $t_v$ that the port 94*b* is held open and vacuum pressure is being applied to the sealing device 40, the circulation of blood near the surface of the skin is enhanced resulting in a number of therapeutic effects, such as fat removal or breast enhancement, depending on the values set for $t_V$ and $t_A$.

If, in step 414, the current time t is determined to be greater than or equal to the sum of $t_1$, and $t_V$, then execution proceeds to step 416, wherein the control board 78 (FIG. 1) generates a signal onto the line 86 (FIG. 3) to cause the actuator 90 to close the first port 94*b* and open the second port 94*c* of the three-way valve 94. The action of the actuator 90 is effective to close off fluid communication between the vacuum pump 100 and the sealing device 40, and to permit air at atmospheric pressure to enter through the inlet 32, the tube 122, the three-way valve 94 (as indicated schematically by the arrow 122*a*), the tube 114, the tee 116, the tube 115 (as indicated schematically by the arrow 115*b*), the tube 36, and the sealing device 40, thereby relieving the vacuum pressure in the sealing device 40. In step 416, the control board 78 also sets the time value $t_1$, equal to the current time, in a manner well-known in the art, using a current time value available from the internal clock (not shown) mounted on the control board 78.

In step 418, the control board 78 compares the current time t with the sum of $t_1$, and $t_A$. If the current time t is determined to be less than the sum of $t_1$ and $t_A$, then the step 418 is repeated, and atmospheric pressure is maintained in the sealing device 40. If, in step 418, the current time t is determined to be greater than or equal to the sum of $t_1$, and $t_A$, then execution proceeds to step 420.

In step 420, the control board 78 determines whether the desired treatment time has elapsed, by comparing the current time t with the sum of $t_0$ and the total treatment time $t_T$. If the current time t is determined to be less than the sum of $t_0$ and the total treatment time $t_T$, then execution returns, or cycles back, to step 412. A treatment may comprise several hundred such cycles wherein execution returns to step 412, the number of cycles ranging, for example, from about 100 to about 1,000 such cycles and, typically, from about 300 to about 700 such cycles and, preferably, about 500 such cycles.

If, in step 420, the current time t is determined to be greater than or equal to the sum of $t_0$ and the total treatment time $t_T$, then execution proceeds to step 422. A user may also direct the system 10 to go directly to step 422 at any time by engaging the stop button 62. In step 422, the control board 78 (FIG. 1) generates a signal onto the line 98 (FIG. 3) to deactivate operation of the vacuum pump 100. In step 424, the sealing device 40 is removed from the user's body. Step 426 represents completion of a treatment on a user in accordance with the present invention.

By the use of the present invention shown in FIG. 1, a user may loose fat and/or enhance and/or heal selected portions of his/her body without diet, exercise, or expensive medicinal treatment, surgery, or chiropractic or massage therapy.

It is understood that the present invention can take many forms and embodiments. Accordingly, several variations may be made in the foregoing without departing from the spirit or the scope of the invention. For example, the system 10 may be configured to permit a trained operator to manually control when signals are generated by the control board 78 to the vacuum pressure generator unit 20 and actuator 90, for applying and releasing vacuum pressure and terminating treatment.

In another variation, a suitable filter (not shown) may optionally be serially positioned in the tube 115 for permitting gas such as air or oxygen to flow freely therethrough and for preventing particles such as flakes of skin and the like from passing through the tube 115 and entering the three-way valve 94, the pressure gauge 120, and the vacuum control valve 96, and/or the pump 100. Additionally, a suitable safety pressure relief valve (not shown) may optionally be positioned on the line 118 for preventing a vacuum pressure greater than a predetermined vacuum, such as 30 kPa, from being applied through the sealing device 40 (FIG. 1).

Figure 5:
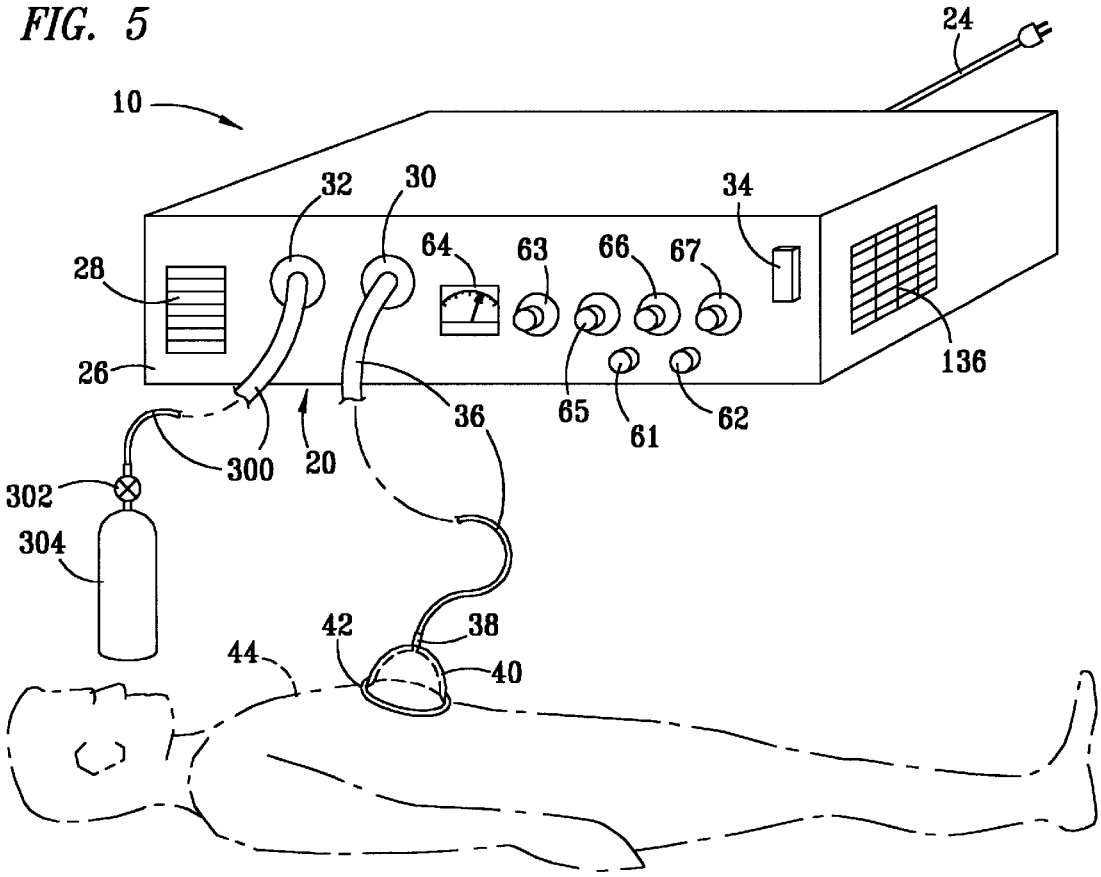
FIG. 5 shows an alternate embodiment of the present invention.

In still another variation, a gas, other than air, such as oxygen, may be supplied to the pressure inlet 32 for enhancing the healing of open wounds on a user's skin. Such an embodiment is depicted in FIG. 5 in which the pressure inlet 32 is connected via a pneumatic tube 300 to a valve 302 on a tank 304 containing pressurized oxygen, or other suitable gas. Then, when the vacuum pressure in the sealing device 40 is released, as in step 416 above, the sealing device 40 is filled with oxygen, or other suitable gas, instead of air. The valve 302 may be replaced with a three-way valve or an arrangement of valves to permit either oxygen or air or a combination thereof to be released into the sealing device 40.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Accordingly, it is appropriate that the appended claims be construed broadly and in a manner consistent with the scope of the invention.

Having thus described the invention, what is claimed is:

1. A method for passively exercising a selected portion of a human body, the method comprising the steps of:

(a) applying a partial vacuum pressure to the selected portion of the human body;

(b) maintaining the partial vacuum pressure applied to the selected portion of the human body for a first predetermined period of time;

(c) releasing the partial vacuum pressure so that substantially atmospheric pressure is applied to the selected portion of the human body;

(d) maintaining the substantially atmospheric pressure applied to the selected portion of the human body for a second predetermined period of time; and (e) cyclically repeating steps (a) through (d) to the selected portion of the human body a preselected number of times.

2. The method of claim 1 wherein the step of applying a partial vacuum pressure to the selected portion of the human body further comprises controlling the maximum vacuum pressure with a pressure regulator.

3. The method of claim 1 wherein the steps of applying and releasing further comprise connecting a first port of a three-way valve in fluid communication with the selected portion of the human body, connecting a second port of the three-way valve in fluid communication with vacuum pressure, connecting a third port of the three-way valve in fluid communication with atmospheric pressure, and wherein the step of applying further comprises actuating the three-way valve so that fluid communication is established between the first port and the second port but shut off between the first port and the third port, and the step of releasing further comprises actuating the three-way valve so that fluid communication is established between the first port and the third port but shut off between the first port and the second port.

4. The method of claim 1 wherein the selected portion of the human body is selected from a group consisting of fatty tissue, muscle tissue, a breast, a penis, a portion of a leg, a foot, a portion of an arm, an arm, a portion of a back, a healing portion of skin, and a wrinkled portion of skin.

5. The method of claim 1 wherein the step of applying a partial vacuum pressure further comprises sealing the selected portion of the human body to form a sealed portion of the human body to which the partial vacuum pressure may be applied and controlled.

6. The method of claim 1 wherein the step of applying a partial vacuum pressure further comprises sealing the selected portion of the human body with a sealing device to form a sealed portion of the human body to which pressure may be applied and controlled, and the step of releasing further comprises injecting substantially pure oxygen into the sealing device until the pressure in the sealing device is substantially atmospheric pressure.

7. The method of claim 1 wherein the step of applying a partial vacuum pressure further comprises sealing the selected portion of the human body with a sealing device to form a sealed portion of the human body to which pressure may be applied and controlled, and the step of releasing further comprises releasing atmospheric air into the sealing device until the pressure in the sealing device is substantially atmospheric pressure.

8. The method of claim 1 wherein the selected portion of the human body is a woman's breast, and the step of applying a partial vacuum pressure further comprises sealing off the breast so that a partial vacuum pressure may be applied to the breast and controlled to enhance the size of the breast.

9. The method of claim 1 wherein the selected portion of the human body is a woman's breast, and the step of applying a partial vacuum pressure further comprises sealing off the breast so that pressure may be applied to the breast and controlled, and wherein the first predetermined period of time and the second predetermined period of time are each from about 3 seconds to about 12 seconds, to enhance the size of the breast.

10. The method of claim 1 wherein the selected portion of the human body is fatty tissue, and the step of applying a partial vacuum pressure further comprises sealing off the fatty tissue so that a partial vacuum pressure may be applied to the fatty tissue and controlled to remove at least a portion of the fatty tissue.

11. The method of claim 1 wherein the selected portion of the human body is fatty tissue, and the step of applying a partial vacuum pressure further comprises sealing off the fatty tissue so that a partial vacuum pressure may be applied to the fatty tissue and controlled, and wherein the first predetermined period of time and the second predetermined period of time are each from about 1 second to about 5 seconds.

12. The method of claim 1 wherein the partial vacuum pressure is from about 5 kPa of vacuum to about 40 kPa of vacuum, and typically from about 10 kPa of vacuum to about 30 kPa of vacuum, and preferably about 20 kPa of vacuum.

13. The method of claim 1 wherein the first predetermined period of time and the second predetermined period of time are each from about 1 second to about 5 seconds.

14. The method of claim 1 wherein the first predetermined period of time and the second predetermined period of time are each from about 3 seconds to about 12 seconds.

15. The method of claim 1 wherein at least ten minutes elapse during the time that the steps (a) through (d) are cyclically repeated.

16. The method of claim 1 wherein the step of cyclically repeating the steps (a) through (d) is performed at least twice per minute.

17. The method of claim 1 wherein the step of applying a partial vacuum pressure is performed using an electrically powered pump.

18. A system for passively exercising a selected portion of a human body, the system comprising:

(a) a pump configured for generating a partial vacuum pressure;

(b) a three-way valve having a first port, a second port, and a third port, wherein the second port is connected in fluid communication with an outlet of the pump, and the third port is connected in fluid communication with atmospheric pressure;

(c) a sealing device configured for providing a pressure seal over the selected portion of the human body, the sealing device being connected in fluid communication with the first port of the three-way valve so that when the second port is open, fluid communication is established between the sealing device and the outlet of the pump, and so that when the second port is open, fluid communication is established between the sealing device and atmospheric pressure; and (d) an actuator configured for opening the second port or the third port in response to signals received from a control board.

19. The system of claim 18 further comprising a pressure regulator valve connected in series between the sealing device and the pump for controlling the maximum amount of vacuum pressure which may be communicated from the pump to the sealing device.

20. The system of claim 18 further comprising a pressure regulator valve connected in series between the sealing device and the pump for enabling a user to control the maximum amount of vacuum pressure which may be communicated from the pump to the sealing device.

21. The system of claim 18 wherein the sealing device is configured for sealing a portion of a human body selected from the group consisting of fatty tissue, muscle tissue, a breast, a penis, a portion of a leg, a foot, a portion of an arm, a hand, a portion of a back, a healing portion of skin, and a wrinkled portion of skin.

22. The system of claim 18 further comprising a source of substantially pure oxygen, the source having an outlet in fluid communication with the third port of the three-way valve for permitting the oxygen to pass into the sealing device when the pressure in the sealing device is released to atmospheric pressure.

23. The system of claim 18 wherein the pump is an electrically powered pump.

24. A method for passively exercising a selected portion of a human body, the method comprising the steps of:

(a) applying a first absolute pressure to the selected portion of the human body, the first absolute pressure being less than atmospheric pressure;

(b) maintaining the first absolute pressure applied to the selected portion of the human body for a first predetermined period of time;

(c) releasing the pressure applied to the selected portion of the human body to a second absolute pressure greater than the first absolute pressure;

(d) maintaining the second absolute pressure applied to the selected portion of the human body for a second predetermined period of time; and (e) cyclically repeating steps (a) through (d) to the selected portion of the human body.

25. The method of claim 24 wherein the step of applying a first absolute pressure to the selected portion of the human body further comprises controlling the maximum first absolute pressure with a pressure regulator.

26. The method of claim 24 wherein the steps of applying and releasing further comprise connecting a first port of a three-way valve in fluid communication with the selected portion of the human body, connecting a second port of the three-way valve in fluid communication with vacuum pressure, connecting a third port of the three-way valve in fluid communication with atmospheric pressure, and wherein the step of applying further comprises actuating the three-way valve so that fluid communication is established between the first port and the second port but shut off between the first port and the third port, and the step of releasing further comprises actuating the three-way valve so that fluid communication is established between the first port and the third port but shut off between the first port and the second port.

27. The method of claim 24 wherein the first absolute pressure is a partial vacuum pressure and the second absolute pressure is substantially atmospheric pressure.

28. The method of claim 24 wherein the first absolute pressure is a partial vacuum pressure and the second absolute pressure is non-atmospheric pressure.

29. The method of claim 24 wherein the step of cyclically repeating the steps (a) through (d) is performed at least twice per minute.

30. The method of claim 24 wherein the step of applying a first absolute pressure is performed using an electrically powered pump.

* * * * *

UNITED STATES PATENT AND TRADEMARK OFFICE

CERTIFICATE OF CORRECTION

PATENT NO. : 6,277,052 B1
DATED : August 21, 2001
INVENTOR(S) : Kenneth W. Howard It is certified that error appears in the above-identified patent and that said Letters Patent is hereby corrected as shown below:

Column 5,
Line 49, delete "to" insert -- $t_0$ --

Column 6,
Lines 17, 28, 41, 46, and 50, delete "$t_1$," insert -- $t_1$ --

Signed and Sealed this

Twenty-sixth Day of February, 2002

*Attest:*

*Attesting Officer*

JAMES E. ROGAN
*Director of the United States Patent and Trademark Office*